US006306109B1

(12) United States Patent
Polychronis

(10) Patent No.: US 6,306,109 B1
(45) Date of Patent: Oct. 23, 2001

(54) ROTATING APPARATUS FOR SURFACE MASSAGE

(76) Inventor: Gus Polychronis, 3112 - 38 Street SW., Calgary, Alberta (CA), T3E 3G3

( * ) Notice: Subject to any disclaimer, the term of this patent is extended or adjusted under 35 U.S.C. 154(b) by 0 days.

(21) Appl. No.: 09/387,863

(22) Filed: Sep. 1, 1999

(51) Int. Cl.[7] ..... A61H 19/00

(52) U.S. Cl. ..... 601/137; 601/128; 601/129; 601/131; 601/132; 601/134

(58) Field of Search ..... 601/125–129, 601/137, 131, 132, 134

(56) References Cited

U.S. PATENT DOCUMENTS

| | | |
|---|---|---|
| D. 396,296 | 7/1998 | Breznik . |
| D. 396,297 | 7/1998 | Breznik . |
| D. 404,139 | 1/1999 | Young . |
| D. 405,888 | 2/1999 | Antoskow . |
| 3,645,256 | 2/1972 | Morrison . |
| 4,210,135 | 7/1980 | Deuser . |
| 5,364,338 | 11/1994 | Terashima . |
| 5,531,665 | 7/1996 | Chen . |
| 5,554,102 | 9/1996 | Chiou . |
| 5,711,758 | 1/1998 | Tseng . |
| 5,725,484 | 3/1998 | Burnham . |

FOREIGN PATENT DOCUMENTS

| | | | |
|---|---|---|---|
| 4-44767 A | * | 2/1992 | (JP) . |
| 9-327491 A | * | 12/1997 | (JP) . |
| 11-128312 A | * | 5/1999 | (JP) . |
| 11-137634 | * | 5/1999 | (JP) . |

* cited by examiner

*Primary Examiner*—Michael A. Brown
*Assistant Examiner*—Lalita M. Hamilton
(74) *Attorney, Agent, or Firm*—Gene Scott-Patent Law & Venture Group

(57) ABSTRACT

A hand held manual massager is constructed as a cylindrical cage with a series of axles arranged in a circular or near circular array. Each of the axles provides a series of side-by-side massaging wheels. The wheels have a ridged circumference for rolling on the surface of the skin in a manner for stimulating the muscles and circulatory system.

6 Claims, 1 Drawing Sheet

ROTATING APPARATUS FOR SURFACE MASSAGE

BACKGROUND OF THE INVENTION

1. Field of the Invention

This invention relates generally to manual tools for massaging the surface of the body, and more particularly to such a tool providing a plurality of small wheels arrange on a cylindrical frame for massaging multiple surface areas simultaneously.

2. Description of Related Art

The following art defines the present state of this field:

Breznik, U.S. Pat. No. Des. 396,296 describes an ornamental design for a massager.

Brezrik, U.S. Pat. No. Des. 396,297 describes an ornamental design for a massager.

Burnham, U.S. Pat. No. 5,725,484 describes a manual personal massager comprising of handles to be gripped by the hand of a person. A web network grid is provided. A facility is for attaching opposite ends of the web network grid to the pair of handles. A plurality of massaging members are carried in the web network grid to be applied to a body part of a person and moved back and forth by the movement of the pair of handles.

Morrison, U.S. Pat. No. 3,645,256 describes a massage-exerciser device consisting of a number of resilient discs of frustoconical shape assembled in stacked coaxial relation to form a roller having peripheral ribs and grooves, said discs being reversible whereby to vary the pattern of said ribs and grooves, hard and soft spacers adapted to be inserted selectively between said discs whereby to increase or decrease the effective hardness of the roller, and a clamp for applying a variable axial compressive load to said roller, also to vary the effective hardness thereof, and a frame for carrying a plurality of said rollers rotatably in parallel, spaced-apart relation.

Deuser, U.S. Pat. No. 4,210,135 describes a plurality of non-rotating disc-shaped massaging members, which are fixed, on a flexible shaft held at its ends by a bow. Spherical rolling members between the massaging members space the massaging members apart and limit their depth of depression into the skin.

Chiou, U.S. Pat. No. 5,554,102 describes a portable massaging device which comprises of a cylindrical body in which a power unit is housed and over which a massaging set is fitted. The power unit is composed of a motor, a battery set, a cam and a conducting member. The massaging set is composed of a plurality of fitting members and massaging nipples. The fitting members are provided respectively with a plurality of receiving recesses in which the massaging nipples are held. The fitting members are further provided respectively in the connection ends thereof with a plurality of mortises and tenons, by way of which the fitting members are held together. An end cap is fastened to one end of the cylindrical body for locating the massaging set and for shielding the power unit. A handle is fastened at one end thereof with the end cap and at another end thereof with the conducting member.

Antoskow, U.S. Pat. No. Des. 405,888 describes an ornamental design for a massager.

Tseng, U.S. Pat. No. 5,711,758 describes a handy body massager including a casing defining a substantially U-shaped handle, a barrel supported on rollers in two roller holders between two opposite ends of the handle and having massaging rollers supported on roller racks around the periphery and a fixed connecting block on the inside, a motor fixedly mounted in a motor chamber at one end of the handle, a reducing gear coupled to the motor shaft of the motor and having an output shaft fixedly connected to a connecting block of the barrel and adapted for turning the barrel upon the operation of the motor, a massaging disk coupled to the output shaft of the reduction gear outside the casing and having a plurality of massaging rollers turned about a respective wheel axle at an outer side for massaging.

Chen, U.S. Pat. No. 5,531,665 describes a massaging device which includes a cord, a plurality of massaging balls and a plurality of biasing units strung alternately on the cord, and a connecting unit for joining two ends of the cord together. The biasing units ensure that the massaging balls remain evenly distributed on the cord.

Young, U.S. Pat. No. Des. 404,139 describes an ornamental design for a stimulating massager.

Terashima, U.S. Pat. No. 5,364,338 describes a portable massager which allows self-massaging to be performed in virtually any position. The massager includes at least one pair of pressers mounted at a fixed separation interval onto a rod, which can be separated into two sections, if desired. The pressers may be freely rotatable or non-rotably fixed in position on the rod. The surfaces of the pressers are formed into irregular shapes having indentations and projections. Handles having grips on their ends are either fixed or mounted so as to rotate freely on the rod and project outwardly away from the pressers and toward a respective end of the rod.

The prior art teaches both mechanized and manually operated surface massage devices. Of the manually operated devices; balls, cylindrical rolls and wheels of various shapes, sizes and arrangements are known. Devices are designed for application with one hand or with two and clearly are designed for a wide range of results from vigorous to mild surface massaging and also for deep massage results. However, the prior art does not teach that a surface massaging device may be applied with one hand in a manner whereby multiple, spaced-apart rippled wheel surfaces may be brought into rolling contact with a surface and than drawn along the surface in a back and forth motion to provide a continuous massaging action or, alternately, at the choice of the user, rolled on the surface to bring the rippled wheels into non-rotating contact with the surface. The present invention fulfills these needs and provides further related advantages as described in the following summary.

SUMMARY OF THE INVENTION

The present invention teaches certain benefits in construction and use which give rise to the objectives described below.

The present invention provides a hand held manual massager constructed as a cylindrical cage with a series of axles arranged in a circular or near circular array. Each of the axles provides a series of side-by-side massaging wheels. The wheels have a ridged circumference for rolling on the surface of the skin in a manner for stimulating the muscles and circulatory system. The device is approximately the width of a hand and of such size as to be grasped by a hand for manipulation on the body for massage.

A primary objective of the present invention is to provide a manual surface massage device having advantages not taught by the prior art.

Another objective is to provide such a massaging device enabled for surface auto-massage.

A further objective is to provide such a massaging device capable of being rolled on separate small wheels or being rotated.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
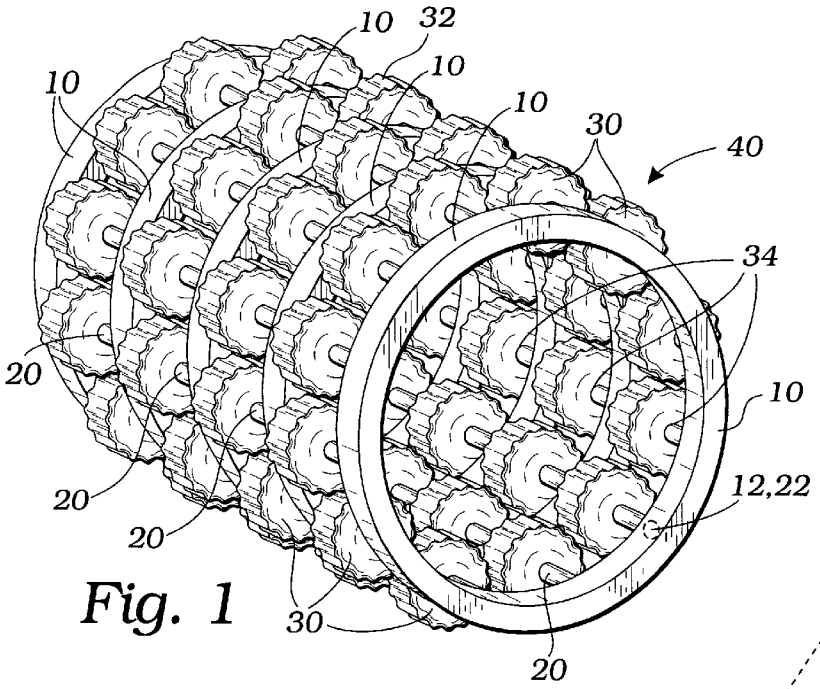
FIG. 1 is a perspective view of a first preferred embodiment of the present invention shown formed as a regular cylinder.
Figure 2:
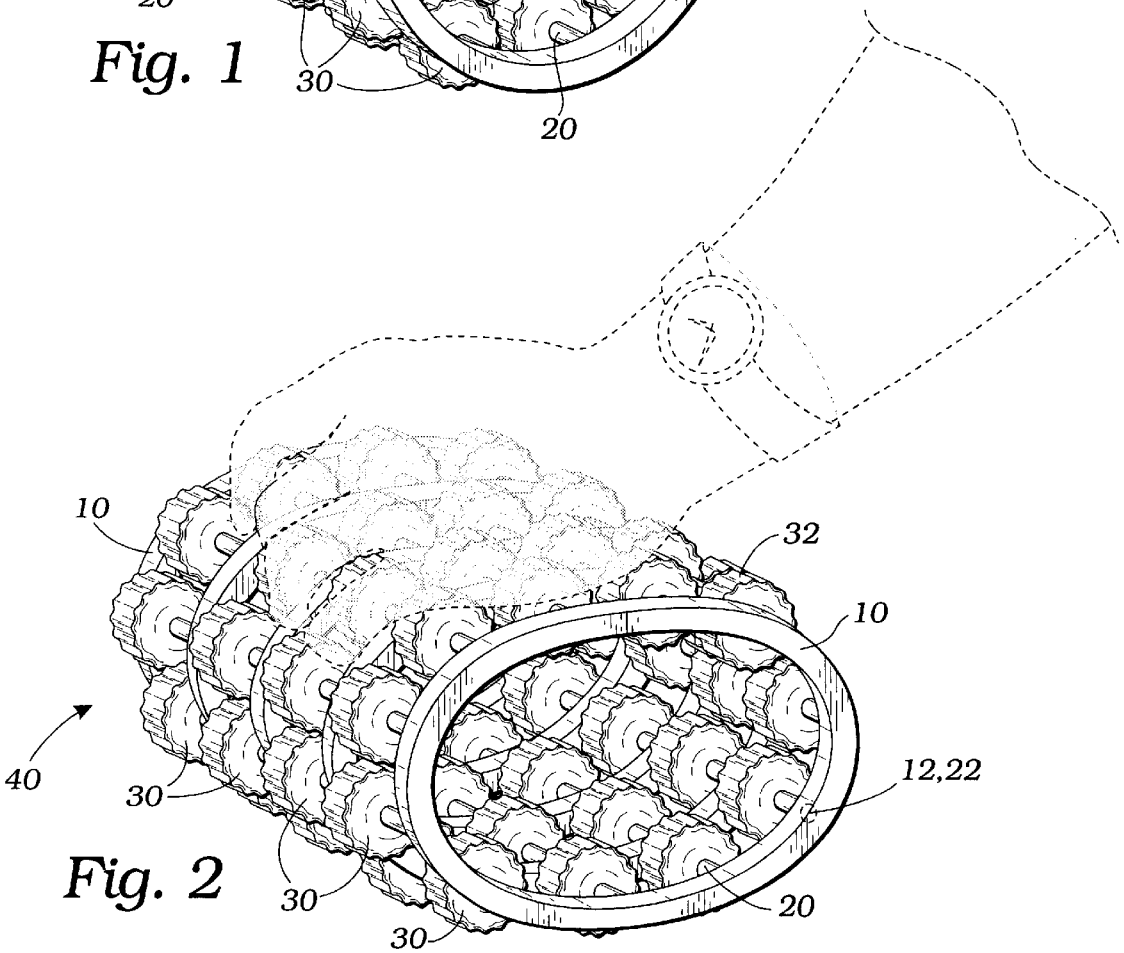
FIG. 2 is an alternate embodiment of the present invention shown in the form of an oval cylinder.

The above described drawing figures illustrate the invention, a manual massaging apparatus comprising three essential structural elements. The first of these elements is a plurality of spaced apart frame members 10, each preferably formed as a disk or as a circular or oblate (oval) ring as shown in FIGS. 1 and 2. Each of the frame members provides a plurality of axle receiving means 12 such as holes arranged in parallel and in a closed figure such as a circle or non-circular shape, e.g., an oval. The frame members 10 are preferably made of metal or plastic and are rigid elements in the preferred embodiment, but may inventively have some flexibility or resilience so that FIG. 2 may represent the assembly of FIG. 1 when hand pressure is applied to it, as for example.

The second structural element is a plurality of linear axle shafts 20 all of which preferably have a common diameter and length. Each of the axle shafts 20 provide opposing terminating ends 22 which are frictionally received by the axle receiving means 12 so as to enable the axle shafts 20 and the frame members 10 to form a rigid cage structure.

The third structural element of the present invention is a plurality of identical disk shaped wheels 30, each of the which provide a peripheral, generally circular and irregular surface 32, as is clearly shown in the figures. Each of the wheels 30 provide a central axial hole 34 for receiving one of the linear axle shafts 20 such that each of the wheels 30 is able to freely rotate on the axle shaft 20 it is mounted on, i.e., the central axial hole 34 is large enough for the wheel to freely rotate on its axle shaft 20.

The linear axle shafts 20 are engaged with the axle receiving means 12 of the frame members 10 and the central axial holes 34 of the disk shaped wheels 30 to form a cylindrical fixed frame 40 assembly as is shown in the figures. The disk shaped wheels 30 are positioned within and form a part of a sidewall of the cylindrical fixed frame 40. Each of the disk shaped wheels 30 on each of the linear axle shafts 20 is separated from each adjacent one of the disk shaped wheels 30 by one of the frame members 10 which therefore establishes a preferred common lateral wheel spacing in the apparatus. This is advantageous during massage since it allows the flesh to move laterally when pressed by a given wheel 30 and this action, as is well known, is highly therapeutic.

Of significant importance and inventive novelty is the fact that the cylindrical fixed frame 40 is slightly longer than the width of an adult hand, as is clearly shown in FIG. 2, and also the apparatus is of such overall circumference that the grasp of the hand is able to encompass between one-forth and one-half of the circumference of the fixed frame 40, i.e., enough of the frame as to enable one hand control of the apparatus during it use. It has been discovered that this size and shape is particularly advantageous in two respects. First, the device is compact for simple and easy handling, use, storage, porting, etc. Second, the device is highly effective when the force of a single adult hand is applied to between 12 and 20 of the wheels 30 at one time, the massaging pressure and massage motion flow to the tissues has been found to be analogous to that of the techniques used by a well trained masseuse.

In use the instant invention is advantageously applied to the surface of the body to produce certain benefits such as relaxing of muscles, improved blood flow, skin toning and other well known benefits which are well defined in the massage practice and literature. The disk shaped wheels 30 may be placed in a circular line, one behind the next, around the apparatus between each set of spaced apart frame members 10, or they may be placed in alternating offset positions, for example, so that the massaged tissue is, again, as described above, moved from side to side during rolling action for improved therapy. The design shown in FIG. 2 provides the improvement of placing more of the wheels 30 into contact with the surface at one time and this may occur by constructing the frame with the shape shown in FIG. 2, or by constructing the frame 40 as shown in FIG. 1 but enabling the frame 40 to be resiliently compressed by hand pressure into the shape shown in FIG. 2.

The present invention may be used by simply pressing it into the skin's surface without any motion whatsoever, or by holding the frame 40 so that it cannot rotate and moving it across the skin's surface in a forward and backward oscillating motion, or, finally, by allowing the frame 40 to rotate about its own axis, thereby bringing rows of the wheels 30 into contact with the shin's surface in a continuous sequential manner.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A manual massaging apparatus comprising:

a plurality of linear axle shafts, each of the axle shafts providing opposing ends thereof;

a plurality of identical wheels mounted for rotation on each one of the linear axle shafts;

a plurality of aligned and spaced apart circular frame members, the linear axle shafts engaged with the frame so as to form a cylindrical assembly; the wheels positioned within and forming a sidewall of the cylindrical assembly, with each of wheels extending circumferentially beyond the circular frame members.

2. The apparatus of claim 1 wherein the closed figure is circular.

3. The apparatus of claim 1 wherein the closed figure is non-circular.

4. The apparatus of claim 3 wherein the non-circular closed figure is an oval.

5. The apparatus of claim 1 wherein the cylindrical fixed frame is slightly longer than the width of a hand of an adult and wherein the grasp of said adult hand is able to encompass between one-fourth and one-half of the circumference of the fixed frame.

6. The apparatus of claim 1 wherein cylindrical fixed frame is enabled for being pressed resiliently into an oval shape by a massaging force.

* * * * *